US005228735A

United States Patent [19]

Morrow, Sr.

[11] Patent Number: 5,228,735

[45] Date of Patent: Jul. 20, 1993

[54] HYDRAULICALLY OPERATED CLAM BUCKET WITH IMPROVED FORCE TRANSFERRING ARRANGEMENT

[76] Inventor: James G. Morrow, Sr., 3511 Wildwood Dr., Manitowoc, Wis. 54220

[21] Appl. No.: 780,609

[22] Filed: Oct. 23, 1991

[51] Int. Cl.[5] ..... B66C 3/16

[52] U.S. Cl. ..... 294/68.23; 294/88; 37/188

[58] Field of Search ..... 294/68.23, 88; 37/183 R, 187, 188; 414/624, 739

[56] References Cited

U.S. PATENT DOCUMENTS

| | | | |
|---|---|---|---|
| 539,921 | 5/1895 | Pay . | |
| 935,282 | 9/1909 | Strehlow . | |
| 956,269 | 4/1910 | Barwis . | |
| 1,464,718 | 8/1923 | Lovell . | |
| 1,962,700 | 6/1934 | Allard . | |
| 2,501,594 | 3/1950 | Billings . | |
| 2,591,431 | 4/1952 | Henggeler . | |
| 2,621,428 | 12/1952 | Billings . | |
| 2,622,915 | 12/1952 | Horn . | |
| 2,832,634 | 4/1958 | Bergerson . | |
| 2,889,643 | 6/1959 | Chatrenet . | |
| 3,413,029 | 11/1968 | Donovan | 294/68.23 |
| 3,641,689 | 2/1972 | Billings | 37/187 X |
| 3,772,806 | 11/1973 | Meadows | 37/187 X |
| 3,920,137 | 11/1975 | McCain | 294/68.23 X |
| 4,005,894 | 2/1977 | Tucek | 414/739 X |
| 4,242,037 | 12/1980 | Baumgarten | 414/739 |
| 4,260,323 | 4/1981 | Muntjanoff | 414/739 X |
| 4,405,167 | 9/1983 | Kinshofer . | |
| 4,576,406 | 3/1986 | Johnson et al. | 294/88 X |
| 4,654,987 | 4/1987 | Kinshofer . | |
| 4,695,086 | 9/1987 | Kinshofer . | |

FOREIGN PATENT DOCUMENTS

| | | | |
|---|---|---|---|
| 234609 | 5/1960 | Australia | 294/68.23 |
| 42857 | 12/1965 | German Democratic Rep. | 294/68.23 |
| 171177 | 4/1960 | Sweden . | |
| 1557070 | 4/1990 | U.S.S.R. | 294/68.23 |

OTHER PUBLICATIONS

Super Clam II Brochure, 1988 (Heiden, Inc., Model H10020).

*Primary Examiner*—David M. Mitchell
*Assistant Examiner*—Dean J. Kramer
*Attorney, Agent, or Firm*—Foley & Lardner

[57] ABSTRACT

A hydraulically operated clamshell bucket including left and right bucket halves pivotally supported by a bucket carrier. The bucket halves are opened and closed by the operation of a hydraulic cylinder in cooperation with a compensation link. The clamshell bucket provides an improved structural arrangement for transmitting the force from the hydraulic cylinder to the cutting edges of the bucket halves in that for a given size and rated bucket, the weight of the bucket may be reduced along with the complexity and manufacturing cost of the bucket.

17 Claims, 3 Drawing Sheets

HYDRAULICALLY OPERATED CLAM BUCKET WITH IMPROVED FORCE TRANSFERRING ARRANGEMENT

FIELD OF THE INVENTION

The present invention relates to clam buckets which include two bucket halves which are linked together, and opened and closed by a hydraulic cylinder. More particularly, the present invention relates to the transmission of force from the hydraulic cylinder to the bucket halves.

BACKGROUND OF THE INVENTION

Hydraulically operated clam buckets are generally to Kinshofer on Sep. 20, 1983. This clam bucket includes a U-shaped carrier, two bucket halves, and a hydraulic cylinder. The bucket halves are pivoted upon the carrier such that the hydraulic cylinder may open and close the bucket halves for purposes of engaging material with the bucket. In particular, each bucket half includes a torque tube having specially machined ends for accepting the pivoting points on the carrier. This torque tube is fixed to the bucket halves, supports the bucket halves relative to the carrier, and also transmits the force from the hydraulic cylinder to the bucket halves for purposes of moving the bucket halves relative to each other.

One problem with this arrangement is that the torque tubes are relatively complicated, include numerous parts, and are costly to manufacture. Another problem with this arrangement is that it does not directly transfer the force from the hydraulic cylinder to the digging edges of the bucket halves. Rather, the force from the hydraulic cylinder is transmitted to the torque tubes, then to the sides of the buckets, then through the sides of the buckets, through the back member and to the digging edge of the bucket. This requires that the sides of the buckets be made more rigid and thus, heavier and more costly.

Another problem with the bucket arrangement of the '167 patent is that the pivot pins (13A) which connect the carrier to the bucket halves are difficult to remove once they have been engaged with the torque tube arrangement of the bucket. More specifically, buckets of this type are typically used in relatively harsh environments for digging abrasive materials (e.g., sand, gravel, construction debris) which require that pivot pins be removed periodically and replaced, where associated bushings may also be removed.

U.S. Pat. No. 2,621,428 issued to Billings on Dec. 16, 1952 discloses a hydraulically operated clam bucket, similar to that of the '167 patent. However, the bucket of the '428 patent transfers the force from the hydraulic cylinder to rods (15) engaged with the bucket halves. One problem with the arrangement of the '428 patent is that a bucket built according to this disclosure may have unacceptable deflection and/or fatigue failure at the locations in the bucket halves where the cylinder is connected to bearing members 19 and 20.

Accordingly, it would be advantageous to provide a hydraulic operated clam bucket arrangement which is configured to provide a more satisfactory transmission of force from the hydraulic cylinder to the digging edges of the bucket halves, and also provide an arrangement which facilitates the removal and lubrication of pivot pins and bearings which support bucket halves relative to a bucket half carrier. It would be advantageous to provide the arrangement with a configuration to prevent deflection and fatigue of the bucket halves.

It would also be advantageous to provide a bucket having means for rotating the bucket such that the bucket is more maneuverable. Additionally, it may be useful to modify the bucket such that it is capable of readily handling elongated members such as telephone poles or rail road ties.

SUMMARY OF THE INVENTION

The present invention provides a hydraulic clamshell type bucket. The bucket includes a bucket carrier, at least one hydraulic cylinder, and first and second bucket halves each comprising a first side wall, a second side wall, a digging edge, a structural member including lugs for engaging the cylinder and means for pivotally engaging the carrier, and a back wall welded between the side walls and extending from the cutting edge to the structural member, where the structural member extends between and is welded to the side walls and the back wall.

The present invention further provides a hydraulic clamshell type bucket including first and second bucket halves. Each half includes first and second side walls, a digging edge, a structural member including first and second pivot mounts, a pivot lug, and a compensation arm, and a back wall welded between the first and second side walls and extending between the cutting edge and the structural member, where the structural member extends between, and is welded to, the side walls and the back wall. The bucket also includes a compensation link pivotally attached to the compensation arms a hydraulic cylinder pivotally attached between the pivot lugs, and means, pivotally attached between the first and second pivot mounts, for pivotally supporting the first bucket half relative to the second bucket half.

DETAILED DESCRIPTION OF THE PREFERRED EMBODIMENT

Figure 1:
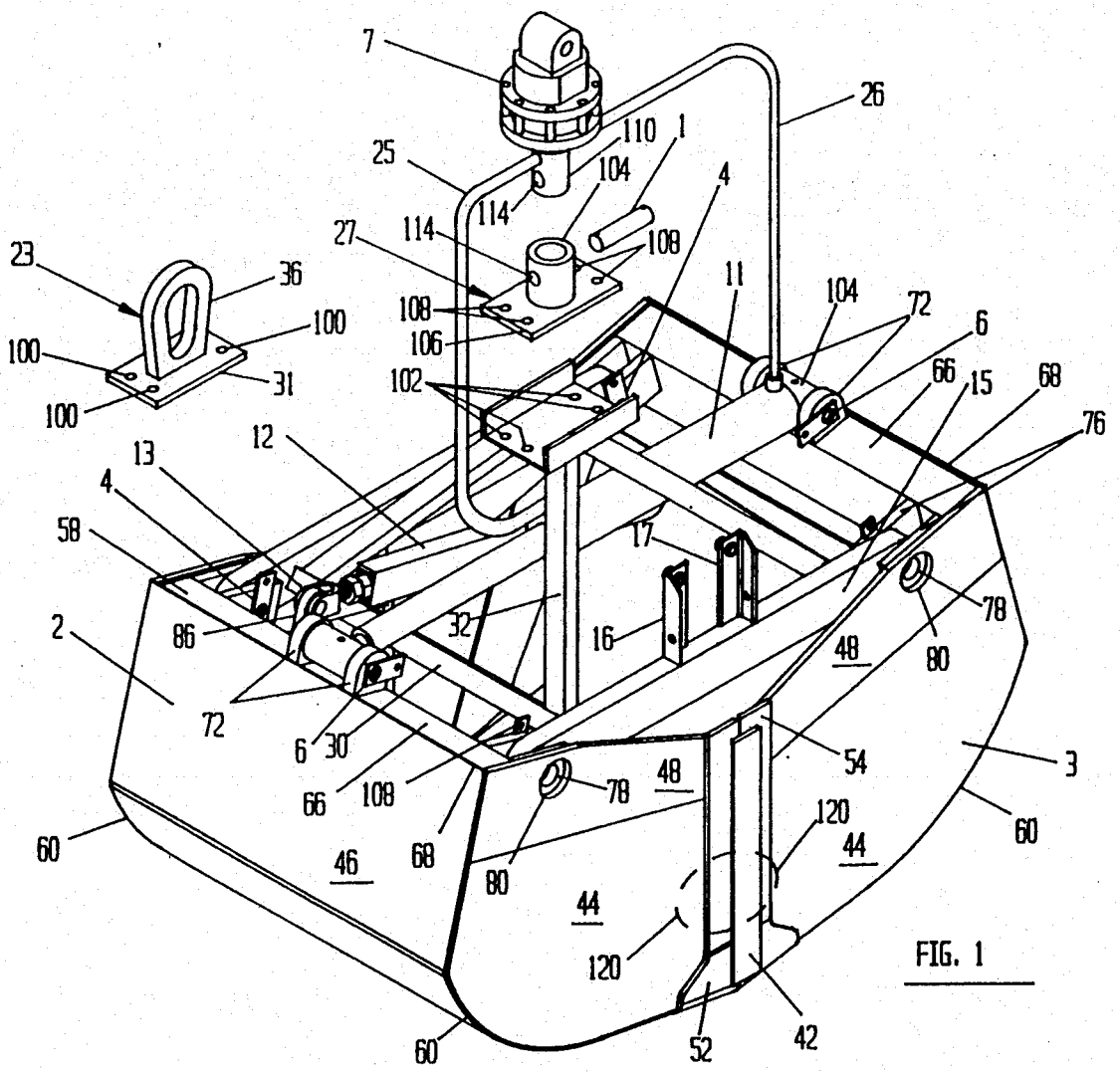
FIG. 1 illustrates a perspective view of a hydraulically operated clam bucket according to one embodiment of the present invention.
Figure 2:
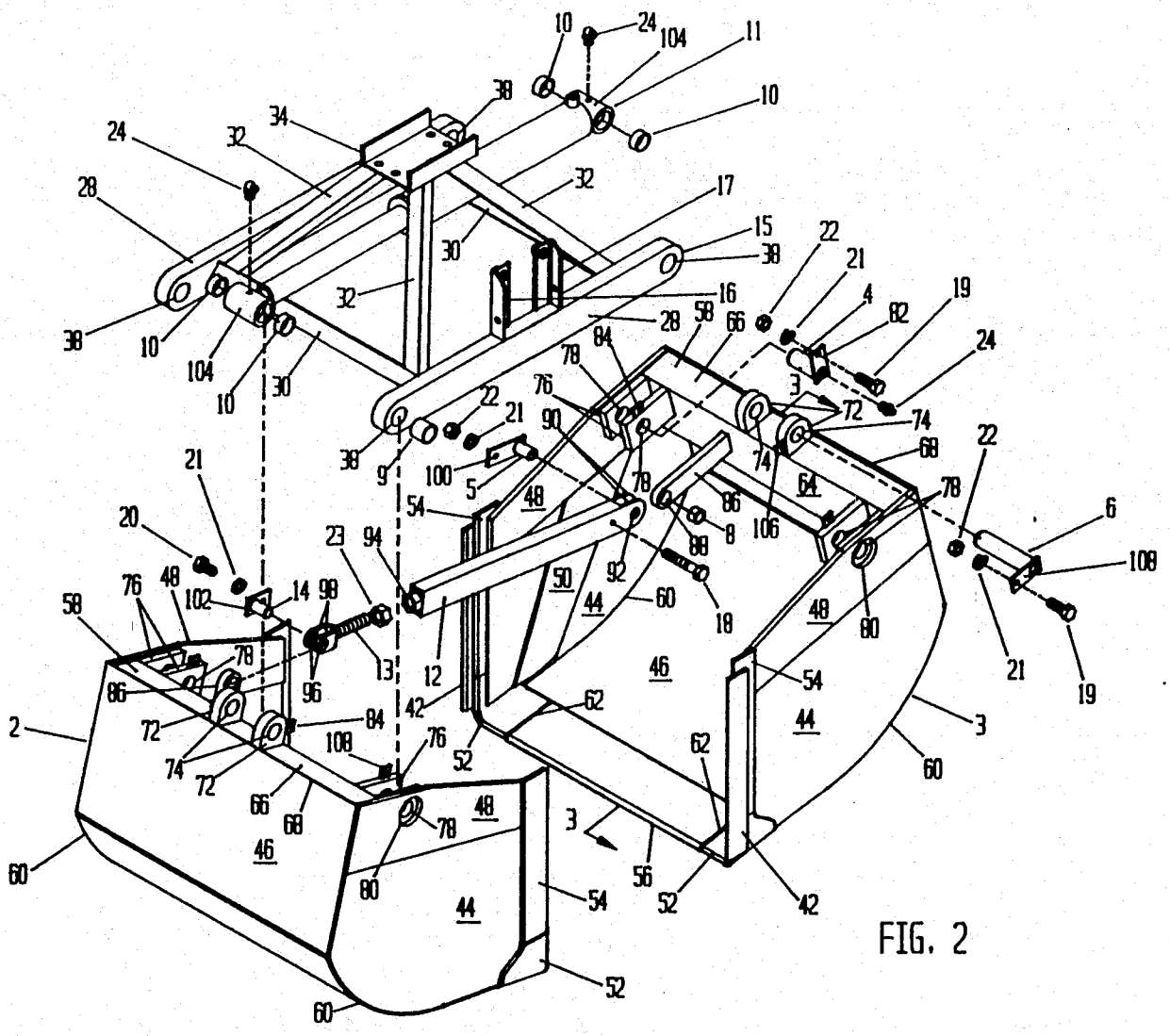
FIG. 2 is a perspective exploded view of the clam bucket.

Referring to FIGS. 1 and 2, the preferred embodiment of a hydraulically operated clamshell bucket includes a left bucket half 2, a right bucket half 3, a hydraulic cylinder 11, a compensation link 12, and a bucket carrier 15. In general, the bucket is raised and lowered by a lifting device such as a crane or end loader for the purpose of digging or moving materials such as sand, gravel, black dirt, etc. In general, the bucket may be conventionally coupled to the lifting device, however, this coupling may be improved by including a hydraulic rotator coupling. The hydraulic rotator provides for controllable rotation of the bucket which assists in handling material. Rotator 7 may be of the type Model FR07 manufactured by Finn-Rotor OY of Finland.

Bucket halves 2 and 3 are pivotally connected to bucket carrier 15 and are pivoted relative to bucket carrier 15 by the interaction of hydraulic cylinder 11 and compensation link 12. In particular, hydraulic cylinder 11 provides the moving force required to open and close bucket halves 2 and 3, where compensation link 12 ensures that both bucket halves 2 and 3 pivot relative to carrier 15. More specifically, without compensation link 12, cylinder 11 would only pivot halves 2 and 3 relative to each other, and independently of their relation to carrier 15. By providing compensation link 12, halves 2 and 3 are pivoted relative to each other by cylinder 11 and also pivoted equal distances relative to carrier 15.

The arrangement of the components of carrier 15 and their relationship to each other is illustrated in FIGS. 1 and 2. Bucket carrier 15 has a generally pyramidal shape, includes two bearing support members 28, two cross members 30, four tension members 32, a lifting channel 34, a removable lifting lug 23, and two hydraulic hose supports 16 and 17. As illustrated in FIG. 2, bearing support members 28 each include a pair of openings 38 at their ends, where a brass bushing 9 is pressed into each of the openings.

The components of bucket carrier 15 are arranged such that bearing support members 28 are parallel, where the center lines of openings 38 on corresponding ends of members 28 are co-linear as illustrated in FIG. 2. Cross members 30 are parallel to each other and welded between members 28 to hold members 28 in their parallel relationship. Tension members 32 each extend from an end of one cross member 30 at the point where the particular cross member is welded to corresponding member 28. The opposite ends of tension members 32 extend up to lifting channel 34, where tension members 32 are welded to cross members 30 and the bottom of lifting channel 34. Lifting lug 23 includes a hook engaging portion 36 welded to a flange 37. Flange 37 includes four holes 100 which correspond with four holes 102 in channel 34, where lug 23 is bolted to channel 34 by four bolts (not shown). Lug 23 provides the interface between the clamshell bucket and the hook or clevis of a lifting devices, where a pin 1 is passed through openings 40 when a hook or clevis is properly located between flanges 36.

By way of modification, lug 23 may be replaced with a hydraulic rotator 7 which may include fluid porting to provide a hydraulic fluid channel to cylinder 11. Rotator 7 is fastened to channel 34 by a coupling 27 which includes a sleeve 104 welded to a flange 106 having four holes 108. A shaft 110 including a hole 112 is configured to engage sleeve 104, where a pin 1 passes through a hole 114 and hole 112 to fasten rotator 7 to coupling 27. Pin 1 is maintained within holes 112 and 114 by the appropriate use of cotter pins, where any other pin and retention arrangement may be used within openings 40.

Rotator 7 allows the bucket to be rotated during the digging operation. For example, the bucket may be used with a knuckle boom crane or replace the bucket on a back hoe, where rotator 7 permits intensive digging maneuverability with the bucket.

Figure 3:
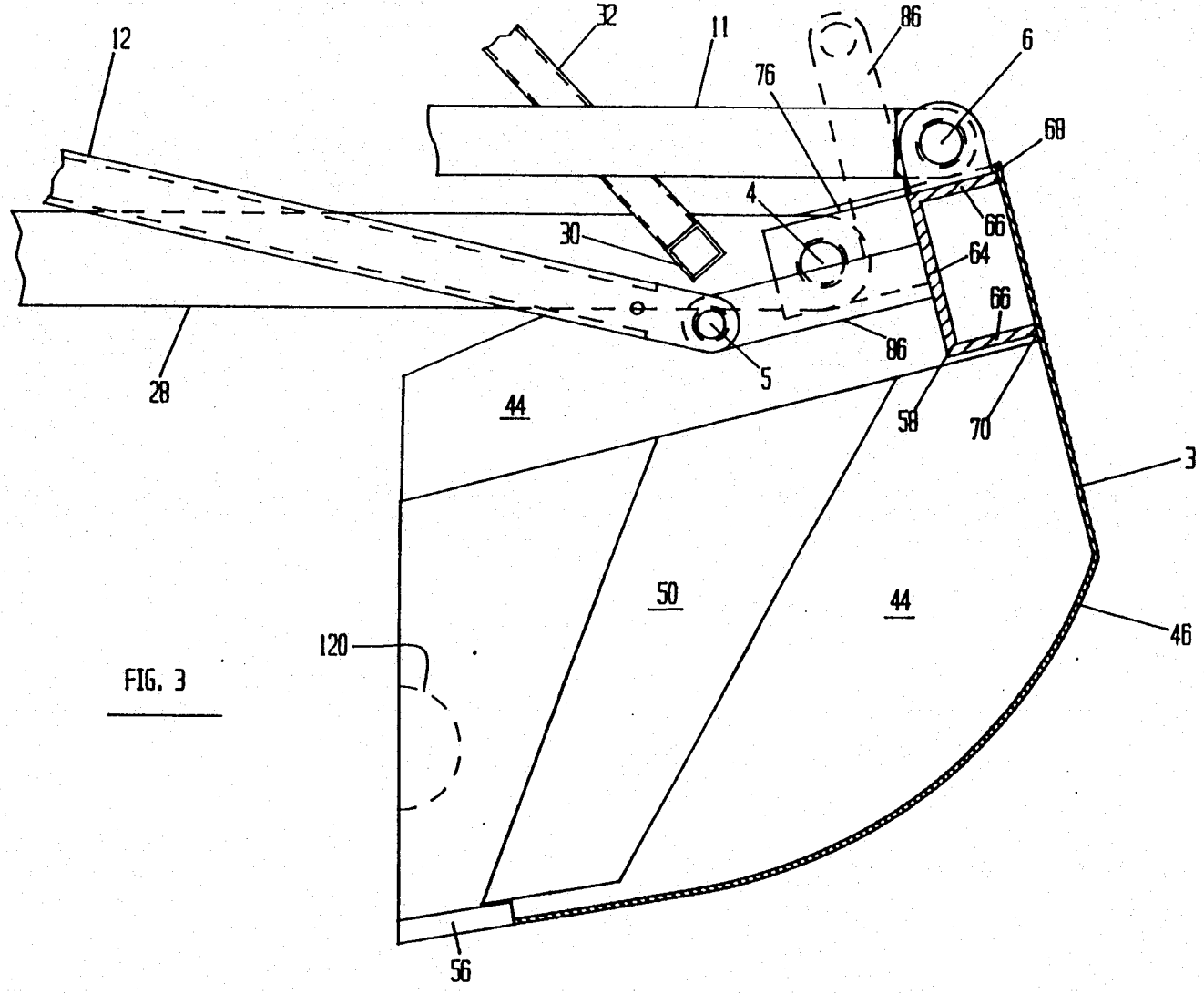
FIG. 3 is a cross-sectional view of a bucket half taken along line 3—3 in FIG. 2.

Left and right bucket halves 2 and 3 are essentially identical to each other, with the exception that they are mirror images of each other, bucket half 3 includes a pair of closing flanges 42, and compensation link 12 is supported at the halves differently. Referring to FIGS. 2 and 3, the configuration, and arrangement of the components of, buckets 2 and 3 is illustrated. Halves 2 and 3 each include side plates 44, back plates 46, top plates 48, stiffening plates 50, edge stiffeners 52, side stiffening plates 54, digging and cutting edge bar 56, and structural member 58. In general, the material being handled by the clamshell bucket is supported, and contained, by side plates 44 and back plate 46. Back plate 46 is the width of its associated bucket half 2 or 3 and may be continuous and extend from cutting edge bar 56 to the top of top plates 48 and structural member 58. Side plates 44 are configured such that their exterior edges may be welded to the associated edges of back plates 46 to form a weld joint 60 extending from edge stiffeners 52 to the top of member 58. Rigidity and durability is provided to the leading or digging edge of halves 2 and 3 by the combination of side stiffening plates 54, edge stiffeners 52, and edge bar 56. More specifically, the leading edge of each side plate 44 is welded to a side stiffening plate 54 and an associated edge stiffener 52, which has an angular shape such that edge stiffener 52 is also welded to associated back plate 46. Edge bar 56 is welded to the leading edge of back plate 46 such that its ends 62 are welded to edge stiffeners 52.

To provide structural support along the top of each half 2 and 3, top plates 48 are welded to the tops of side plates 44 and also to their associate side stiffening plates 54. To provide rigidity and strength to the central portions of side plates 44, if required, stiffening plates 50 extending from joints 60 to top plates 48 may be welded to the interior sides of side plates 44. Stiffening plates 50 are also welded to top plates 48 and back plates 46.

The main structural component of halves 2 and 3 is the structural member 58 which may be a C channel type member extending between top plates 48 along the width of its associated back plate 46. Each member 58 includes a back wall 64 and a pair of side flanges 66. Member 58 is welded along its length to its associated back plate 46 along joints 68 and 70 such that member 58 and the portion of the associated back plate 46 between flanges 6 form a structural member providing substantial rigidity to back plates 46 and a location at which the closing force for halves 2 and 3 may be applied. Top flange 66 includes a pair of pivot lugs 72, each having a circular opening 74 sized to accept a cylinder pin 6. Pivot lugs 72 are welded to flange 66. Back wall 64 of member 58 also supports four pivot flanges 76, each having a circular opening 78 configured to accept a carrier pin 4. The outside pivot flanges 76 are welded to both the back wall 64 and associated top plate 48. The interior pivot flanges 76 are welded to back wall 64 in a parallel relationship with their associated pivot flange 76 such that the center lines of all openings 78 for pivot flanges 76 of a half 2 or 3 are co-linear. To provide for easy removal of pins 4 from openings 78, an opening 80 having its center line co-linear with openings 78 is provided in top plates 48.

By way of modification, side plates 44 of halves 2 and 3 may be configured to include cut outs 120. By providing cut outs 120 (indicated by dashed lines) the bucket may be used to conveniently engage and lift telephone poles, railroad ties, rails or other members which are difficult to handle with the bucket. This modification eliminates the need to unhook the bucket after excavating to handle a member being oriented with respect to the excavation.

When the clamshell bucket is assembled, each end of bearing support members 28 are located between two associated flanges 76 such that the center lines of the associated openings 38 and 78 are co-linear, and pins 4 pass through openings 78 and bushings 9. Each pin 4 may be provided with a grease fitting 24 to allow for lubrication of the pivoting joint between bushings 9, pin 4 and associated flanges 76. Each pin 4 includes a flange 82 and each interior pivot flange 76 includes a flange 84. Flanges 82 and 84 each include an opening configured to accept a bolt 19 which passes through flanges 82 and 84 to hold pin 4 within openings 78 and bushing 9. To hold bolt 19 in the openings of flanges 82 and 84, there is provided an associated lock washer 21 and nut 22.

In addition to pivot flanges 76, compensation bars 86 are also welded to back wall 64. Bars 86 are configured to have an opening 88 at its end opposite to the end welded to back wall 64, where opening 88 is configured to accept a brass bushing 8. The compensation bar 86 of bucket half 3 is welded perpendicular to back wall 64, whereas compensation bar 86 of half 2 is welded parallel to back wall 64 of half 2. (FIG. 3, the parallel arrangement of compensation bar 86 is illustrated by a dashed line.) This arrangement of compensation bars 86 provides the proper opening and closing of halves 2 and 3 when hydraulic cylinder 11 is operated.

By way of example only, bearing support members 28 may be fabricated from solid steel bar stock, and members 30 and 32 may be fabricated from steel tube having a rectangular cross-section.

Compensation link 12 includes a rectangular body portion fabricated from a rectangular tube having a first end fabricated to include two flanges 90, each having an opening 92 to accept a compensation pin 5. The second end of portion 12 is welded to a nut 94 which is engageable with a threaded adjustment lug 13 and associated jam nut 23. Adjustment lug 13 includes a pair of flanges 96, each having an opening 98 configured to accept compensation pin 14. The arrangement of nut 94, adjustment lug 13 and jam nut 23 allows the distance between openings 98 and openings 92 to be adjusted such that compensation link 12 allows for the proper opening and closing of halves 2 and 3 by hydraulic cylinder 11.

When assembled, compensation bar 86 rests between flanges 90 such that the opening in bushing 8 and openings 92 are aligned to accept compensation pin 5, where compensation pin 5 is held within openings 92 by a flange 100 which is fastened to compensation link 12 by a bolt 18, which passes through openings in compensation link 12 and flange 100 and is engaged with an appropriate lock washer 21 and nut 22. Compensation bar 86, associated with half 2, rests between flanges 96 of adjustment lug 13 such that the opening in bushing 8 of this compensation bar and openings 98 are arranged to accept compensation pin 14. Compensation pin 14 includes a flange 102 which interacts with a bolt 20 and a lock washer 21 to hold pin 14 within openings 98, where bolt 20 engages a threaded hole (not shown) in one of flanges 96.

Hydraulic cylinder 11 includes a bushing holder 104 on each of its ends, where each bushing holder is configured to accept a pair of bushings 10 which are pressed into bushing holder 104. Additionally, each bushing holder 104 includes a grease fitting 24 to provide lubrication to bushings 10 and their associated pins 6. When the clamshell bucket is assembled, one bushing holder 104 rests between lugs 72 of bucket half 2, and the other bushing holder 104 rests between lugs 72 of the other bucket half 3 such that a pin 6 associated with each half 2 and 3 passes through the associated openings 74 and bushing 10 to connect the hydraulic cylinder to the associated bucket half 2 or 3. Pins 6 are held within openings 74 and bushings 10 by a pair of flanges 106 and 108 welded to a flange 72 and pins 6, respectively. A bolt 19 passes through an opening in flange 108 and an opening in flange 106 and engages an associated lock washer 21 and nut 22.

As discussed above, bucket half 3 includes a pair of closing flanges 42 which are parallel to and welded to the outside sides of side stiffening plates 54 such that, when halves 2 and 3 are closed, material within clamshell buckets is prevented from leaking out of the interface between plates 54 of halves 2 and 3.

As described above, and shown in FIGS. 1-3, structural member 58 permits the force from hydraulic cylinder 11 to be transmitted directly to one of back plates 46 which transmits the force directly to the associated cutting edge bar 56. Members 58 stiffen back plates 46 at the location where cylinder 11 transmits its force to the back plates via lugs 72, using lugs 72 the bushings 10 may be removed from substantial exposure to material in the bucket, and the abrasive effects of the material, With this arrangement, substantial weight may be eliminated from the clamshell bucket by eliminating the requirement of a torque tube as shown in the prior art. Additionally, the cost of fabricating the clamshell bucket by using a structural member 58 having a cross section such as a C or angle cross section, is also reduced by reducing the complexity of the structure to which bearing support members 28 are pivotally attached.

By way of modification, more than one cylinder 11 may be used for opening and closing valves 2 and 3. This configuration is desirable for wider buckets to provide more uniform closing of halves 2 and 3.

To provide for the attachment of hydraulic hoses to the clamshell bucket, a pair of hydraulic hose supports 16 and 17 are welded to one of bearing support members 28 as illustrated in FIGS. 1 and 2. These hose supports include a connector which connects the hydraulic supply and return lines to hydraulic lines (not shown) connected to hydraulic cylinder 11. Of course, where a rotator 7 is used, supports 16 and 17 are not required.

While one embodiment of the present invention is illustrated and described in detail above, various modifications may be made to the clamshell bucket which fall within the scope of the appended claims.

What is claimed is:

1. A hydraulic clamshell type bucket comprising:
a bucket carrier;
at least one hydraulic cylinder including first and second ends; and
first and second bucket halves each comprising:
a first side wall,
a second side wall,
a structural member including a lug,
means for pivotally engaging the carrier, and
a back wall including a top edge and a digging edge, the back wall being welded between the side walls and extending from the digging edge to the structural member, where the structural member is fastened to the back wall at substantially the top edge such that a force from the cylinder is transferred from the structural member to the digging edge directly through the back wall;
where the first end of the cylinder engages one of the lugs and the second end of the cylinder engages the other of the lugs.

2. The bucket of claim 1, further comprising a cutting bar welded at the digging edge.

3. The bucket of claim 1, where the means for pivotally engaging the carrier comprises at least four flanges and two pins.

4. The bucket of claim 3, where each side wall is welded to a stiffening member.

5. The bucket of claim 1, further comprising an adjustable compensating link, where each structural member includes means for pivotally engaging the link.

6. The bucket of claim 1, where each side wall includes a cut-out disposed to engage an object to be lifted with the bucket.

7. A hydraulic clamshell type bucket comprising:

first and second bucket halves each comprising;

first and second side walls, a digging edge, a top edge, a tubular structural member including first and second pivot mounts, a pivot lug, and a compensation bar, and a back wall welded between the first and second side walls and extending between the digging edge and the structural member, where the structural member extends between and is fastened to the side walls, and is fastened to the top edge of the back wall;

a compensation link pivotally attached to the compensation bars;

a hydraulic cylinder pivotally attached between the pivot lugs such that the force from the cylinder is transferred from the structural member directly to the digging edge through the back wall; and means, pivotally attached between the first and second pivot mounts, for pivotally supporting the first bucket half relative to the second bucket half.

8. The bucket of claim 7, further comprising a cutting bar welded at the digging edge.

9. The bucket of claim 7, where each side wall includes at least one stiffening member.

10. The bucket of claim 7, where each side wall includes a cut-out disposed to engage an object to be lifted with the bucket.

11. A hydraulic clamshell type bucket comprising:

a bucket carrier including a rotator arranged to provide rotational movement to the bucket; and first and second bucket halves each comprising:

a first side wall, a second side wall, a digging edge, a top edge, a tubular structural member including a lug and means for pivotally engaging the carrier, and a back wall welded between the side walls and extending from the digging edge to the structural member, where the structural member extends between and is fastened to the side walls, and the back wall is fastened to the structural member at the top edge such that the force from the cylinder is transferred directly from the structural member to the digging edge through the back wall;

at least one hydraulic cylinder including first and second ends, where the first end of the cylinder is coupled to one of the lugs and the second end of the cylinder is coupled to the other of the lugs.

12. The bucket of claim 11, where the rotator includes porting to channel hydraulic fluid to the cylinder.

13. The bucket of claim 11, further comprising a cutting bar welded at the digging edge.

14. The bucket of claim 11, where the means for pivotally engaging the carrier comprises at least four flanges and two pins.

15. The bucket of claim 14, where each side wall is welded to a stiffening member.

16. The bucket of claim 11, further comprising an adjustable compensating link, where each structural member includes a means for pivotally engaging the link.

17. The bucket of claim 11, where each side wall includes a cut-out disposed to engage an object to be lifted with the bucket.

* * * * *